US006722073B2

(12) United States Patent
Cossio

(10) Patent No.: US 6,722,073 B2
(45) Date of Patent: Apr. 20, 2004

(54) BARREL BLOCKING DEVICE

(76) Inventor: Larry L. Cossio, 187 Carolina Way, Fountain Inn, SC (US) 29644

( * ) Notice: Subject to any disclaimer, the term of this patent is extended or adjusted under 35 U.S.C. 154(b) by 0 days.

(21) Appl. No.: 09/921,443

(22) Filed: Aug. 2, 2001

(65) Prior Publication Data

US 2003/0005614 A1 Jan. 9, 2003

(51) Int. Cl.[7] ..... F41A 35/04
(52) U.S. Cl. ..... 42/96; 42/74; 124/41.1
(58) Field of Search ..... 224/931, 913, 224/193, 150, 149; 206/317; 89/46, 31; 42/96, 70.07, 74; D3/262; 124/41.1

(56) References Cited

U.S. PATENT DOCUMENTS 2,558,792 A * 7/1951 Snowden ..... 42/96
2,884,172 A * 4/1959 Kubo ..... 224/149
3,239,114 A * 3/1966 Norsworthy ..... 206/317
3,653,564 A * 4/1972 Carter ..... 224/150
3,701,371 A * 10/1972 Stackhouse ..... 206/317
4,257,464 A * 3/1981 Binney ..... 150/154
4,280,644 A * 7/1981 Shindelka ..... 224/149
4,475,675 A * 10/1984 Miles ..... 206/317
4,580,707 A * 4/1986 Shoemaker ..... 224/193
4,756,456 A * 7/1988 Schauer ..... 224/913
5,678,344 A * 10/1997 Jones et al. ..... 42/96
6,019,404 A * 2/2000 Pasquale ..... 224/150
6,119,388 A * 9/2000 Jones et al. ..... 42/96
6,256,922 B1 * 7/2001 Jones et al. ..... 42/96

* cited by examiner

*Primary Examiner*—Michael J. Carone
*Assistant Examiner*—L. Semunegus
(74) *Attorney, Agent, or Firm*—Dority & Manning, P.A.

(57) ABSTRACT

A blocking device is provided for a firearm barrel. The blocking device has a cover member, which may be substantially moisture-proof and may be embroidered, embossed, or silk-screened. The cover member has a closed end and an open end, the open end receiving an end of the barrel. A retaining device is affixed to the cover member and releasably holds the end of the barrel in the closed end of the cover member.

12 Claims, 3 Drawing Sheets

BARREL BLOCKING DEVICE

FIELD OF THE INVENTION

The invention relates generally to a blocking device for a barrel of a firearm. More particularly, the invention relates to a blocking device for compressed air-, gas-, or spring-powered firearms or the like (gun) to prevent accidentally discharged projectiles from striking or injuring any object or person in the line of fire and to prevent dust, debris, and other foreign objects from entering the barrel of the gun.

BACKGROUND OF THE INVENTION

Barrel plugs that are inserted in the end of a gun barrel to prevent an accidentally discharged projectile from striking or injuring an object or person in the line of fire are known. Such barrel plugs are also used to prevent dust, debris, and other foreign objects from entering the barrel of the gun.

To provide a secure fit, thus resisting the impact and force of an accidentally discharged projectile, barrel plugs are specifically designed either to closely fit various inner diameters or calibers of different barrel types or they are manufactured with o-rings on the insertion end of the barrel plug to provide a tight fit or seal.

A disadvantage of the known barrel plug is that after multiple uses the o-ring or other sealing feature is often compromised such that the barrel plug may not remain in the barrel after a first, second or third accidental discharge. In this eventuality, persons or objects in the line of fire of the gun may be struck by subsequent discharges. Moreover, a partially dislodged barrel plug may not prevent an expended paint cartridge, for instance, from leaking through a muzzle break or port even if the end of the barrel remains sealed by the plug.

Standard barrel plugs are also somewhat inconvenient to transport, insert and remove from tight barrel insertions to make the gun ready for use. By design, barrel plugs are limited to the caliber or bore size of a specific gun barrel and must be carefully chosen to match the gun barrel at each use. Moreover, barrel plugs may break off in a barrel leaving the gun at least temporarily unusable and possibly requiring costly maintenance.

Users may be less apt to utilize barrel plugs since plugs must be force-fit into and out of the barrel of the gun each time and then stored in a pocket or elsewhere during use of the gun. During these times of non-use, barrel plugs are apt to be lost or to interfere with the user's comfort as they are relatively cumbersome, heavier and bulkier than preferable.

BRIEF SUMMARY OF THE INVENTION

Accordingly, the present invention provides a blocking device for guns in which the component parts of the blocking device are simple and economical to manufacture, assemble, and use. Other advantages of the invention will be apparent from the following description and the attached drawings or can be learned through practice of the invention.

According to an aspect of the invention, a blocking device for a barrel is disclosed for releasably covering the muzzle end of the barrel. The blocking device includes a cover member having an outer surface, an inner surface and a cavity formed within the cover member. The cover member also has a closed end and an opposing open end. The muzzle end of the barrel is inserted into the open end until it rests against the closed end.

A retaining device with a distal end and a proximal end is affixed to the cover member. The distal end releasably holds the closed end against the end of the barrel. In one embodiment, the retaining device may be an elastic cord or other stretchable material. Moreover, an adjustment member can be added to the retaining device to adjustably connect the blocking device to the barrel.

The cover member may be manufactured from any durable material such as nylon, polyester, vinyl or canvas. Such materials make the cover member pliable for easy storage in, for example, the user's pocket during non-use.

The cover member is illustratively elongated. Its greater length relative to its width ensures coverage of a substantial portion of the barrel end, muzzle brakes, or ports. However, the cover member can be manufactured in a variety of other shapes to meet the user's requirements. For instance, the cover member may even be molded from plastic.

Whether the cover member is durable material such as nylon or plastic, ideally the outer surface is substantially moisture-proof. If the selected material is canvas, for instance, the canvas can be pre-treated to be moisture-proof or moisture-resistant. Preferably, the outer surface is also embossable, susceptible to silk screening or embroidable.

A reinforcement member may be affixed to the closed end of the blocking device to reinforce the closed end against the end of the barrel to increase the cover member's durability for repeated use.

According to another aspect of the invention, a safety device for a barrel is disclosed, which includes a pliable, elongated cover member having an outer surface and a cavity therein. The cover member has a closed end and an opposing opening to receive an end of the barrel. A reinforcement member can be affixed to the outer surface at the closed end.

A flexible member such as a strap, with at least two ends attached to the cover member near the opening and which forms a loop, releasably holds the closed end against the end of the barrel. The closed end may be smaller relative to the opening but in all cases, the opening is designed to facilitate easy insertion of the barrel end.

According to another aspect of the invention, a prophylactic device for a barrel end of a firearm is disclosed. Such a device comprises a covering or casing forming a cavity. The casing has an outer surface, a closed end and an opposing open end configured to receive a barrel end of the firearm. A reinforcement member is affixed to the outer surface approximately at the closed end.

The casing ideally encases each of the barrel end, a port and a muzzle brake of the firearm. The casing may be fluorescent or a bright or reflective color to provide a readily seen visual cue and draw attention to the fact that a firearm is in the safe mode.

Optionally, an absorbent material covers a substantial majority of the inner surface of the covering to absorb moisture entering the cavity from the barrel end, for example, due to an accidental discharge. In this manner, paint, for example, can be prevented from leaking during transport of the gun.

In one exemplary embodiment, the reinforcement member may be made of nylon, leather, burlap, canvas or other suitably durable material. The reinforcement member may be attached to the casing near the closed end and cover, for example, as much as a third of the cover member at its closed end. Alternatively, the reinforcement member may be smaller relative to the closed end and attached to the casing approximately at the center of the closed end.

A durable reinforcement member not only protects the cover member from internal pressures of the barrel end but can withstand external pressures from objects outside the firearm such as during transit with other gear or objects rubbing against or abutting the barrel end. In this way, the reinforcement serves the dual purpose of protecting the cover member and the barrel from damage.

The casing may be secured to the firearm in a variety of ways. For example, at least one string or lanyard having a proximal end and a distal end may be attached to the casing by the proximal end. The distal end has a clasping device, which is used to releasably attach the casing to the firearm. The clasping device may be a hook such as an S-hook, a thumb-operated clasp hook, or bolt snap.

Alternatively, the casing may be secured to the firearm by a plurality of strings each having a proximal end and a distal end. Each of the proximal ends are attached to the casing and each of the distal ends are attached to a cupping device. The cupping device can be slipped over any portion of the firearm generally opposite the barrel end. For example, the cupping device, which might be similar to a projectile holder for a slingshot, can be cupped about the hammer area of the firearm to hold the casing in place. The cupping device can be made from any material. Preferably, the cupping device is made of leather, cotton, denim, canvas or the like to prevent damage by scratching the firearm.

An adjustment mechanism may be slidably attached to the string, strings, or cords that releasably secure the casing. The adjustment mechanism, for example, a cord lock, cord stopper, or cord fastener, can be manipulated to adjust the length of the string or cord such that the prophylactic device can accommodate any barrel length. Accordingly, the adjustment mechanism provides versatility such that a single cover or casing may be used with various guns of varying dimensions.

BRIEF DESCRIPTION OF THE DRAWINGS

The above and other aspects, advantages and objectives of the present invention are apparent from the detailed description below in combination with the drawings in which.

DETAILED DESCRIPTION OF THE DRAWINGS

Figure 1:
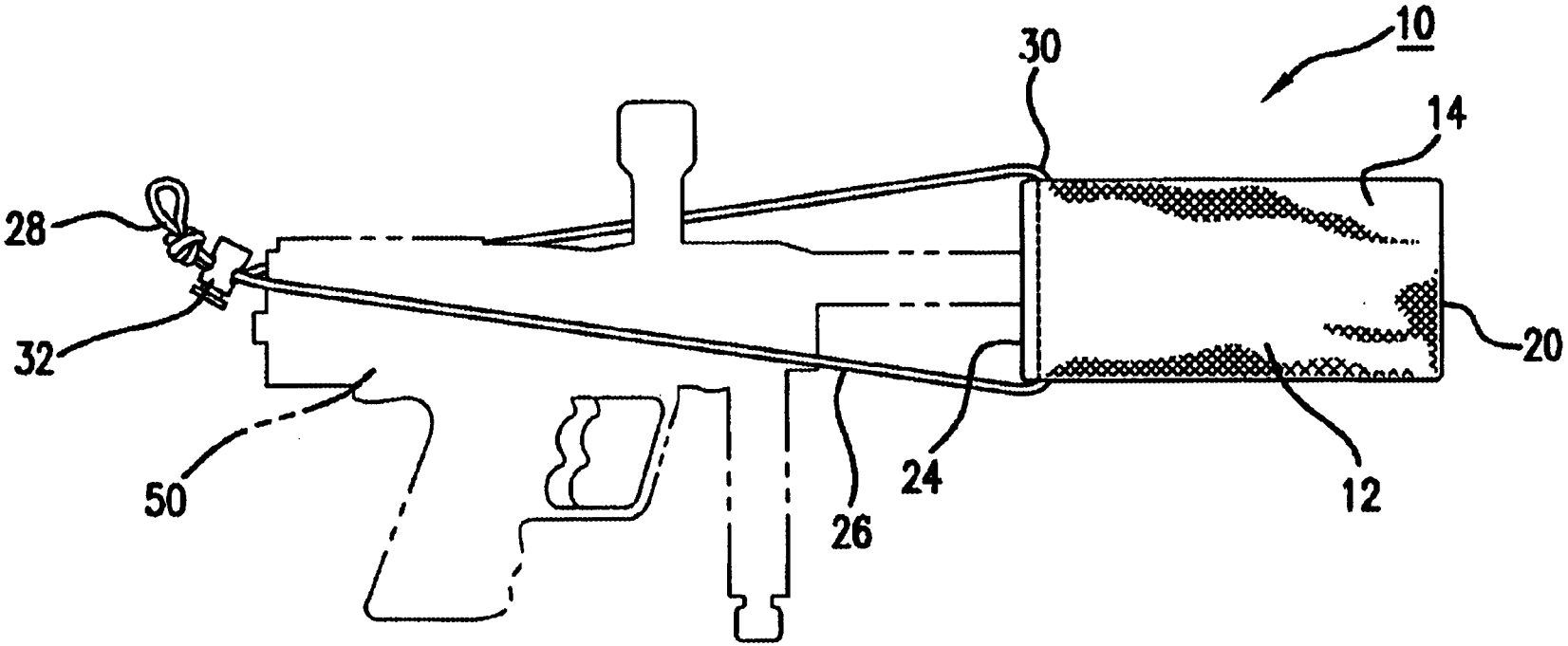
FIG. 1 is a side view of an exemplary embodiment of a barrel blocking device including a cover member, a retaining device, and an adjustment member shown in use on a gun (in phantom) according to the invention.

Detailed reference will now be made to the drawings in which examples embodying the present invention are shown. Repeat use of reference characters in the present specification and drawings is intended to represent same or analogous features or elements of the invention.

The drawings and detailed description provide a full and detailed written description of the invention, and of the manner and process of making and using it, so as to enable one skilled in the pertinent art to make and use it, as well as the best mode of carrying out the invention. However, the examples set forth in the drawings and detailed description are provided by way of explanation of the invention and are not meant as limitations of the invention. It is intended that the present invention include modifications and variations of the following examples as come within the scope of the appended claims and their equivalents.

As broadly embodied in FIGS. 1–6, a barrel blocking device 10 for covering a barrel end (not shown) of a gun 50 is provided. Although the barrel blocking device 10 will be described herein with reference to a gun barrel, particularly a paintball gun, it should be appreciated that the present barrel blocking device 10 has utility for any type of barrel that is preferably kept covered to prevent foreign objects from entering the barrel or to give an immediate visual cue to bystanders that the gun is in safe mode. Accordingly, the present invention is suitable for use with various types of non-lethal firearms or firearms rigged for non-lethal training such as M-16s and M-60s outfitted with laser gear for military and para-military training exercises.

With more particular reference to the Figures, the barrel blocking device 10 is configured to receive a barrel end from gun 50 to prevent accidentally discharged projectiles such as paint charges from hitting and injuring persons or objects in the line of fire. Moreover, barrel blocking device 10 prevents foreign objects such as dirt and debris from entering the barrel end when the gun 50 is not in use. As shown generally in FIG. 1, the barrel blocking device 10 has an exemplary elongated cover member 12 having an outer surface 14, a closed end 20, an open end 24 (seen more clearly in FIG. 5), a retaining device 26, and an adjustment member 32.

FIG. 1 further shows the substantially moisture-proof cover member 12, for example, a nylon, vinyl or other moisture proof material, removably securable at the barrel end of gun 50. Preferably, the moisture-proof material of the cover member 12 can be embossed to display a company's logo, for example.

To employ the barrel blocking device 10, the barrel end of gun 50 is inserted into the open end 24 until the barrel end contacts the inner surface 16 proximate the closed end 20. The retaining device 26, which is connected by its proximal end 30 to the cover member 12 near the open end 24, is then slid over gun 50 at the end substantially opposite the barrel end. At the distal end 28 of retaining device 26, the adjustment member 32 is then adjusted to lengthen or shorten the retaining device 26 and to secure the blocking device 10 to the gun 50. To remove blocking device 10 from the gun 50, the above steps are reversed and further detail need not be given to appreciate or practice the full range of the present invention.

Figure 2:
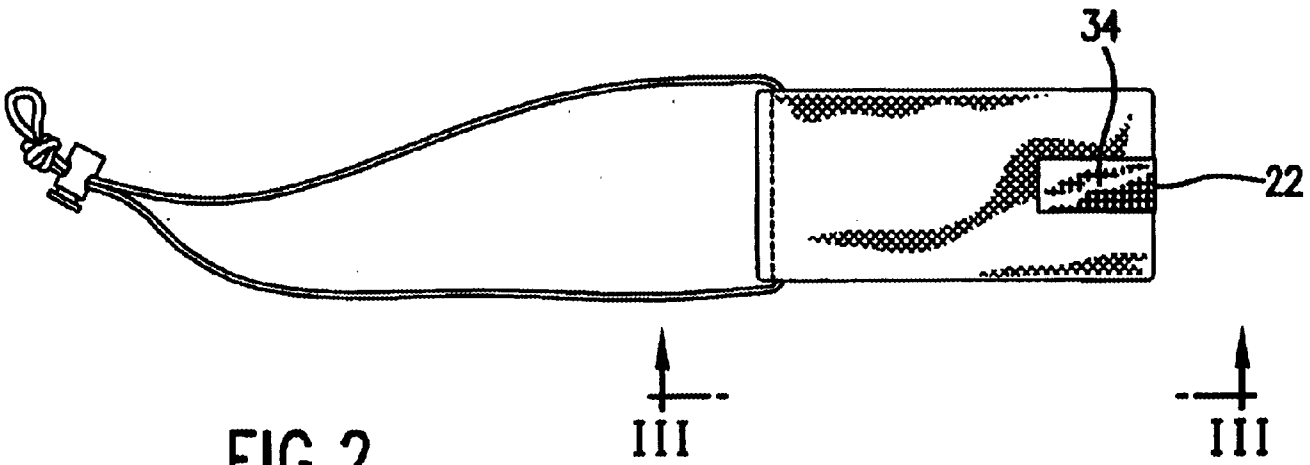
FIG. 2 is the side view of the FIG. 1 embodiment showing an optional reinforcement element.
Figure 3:
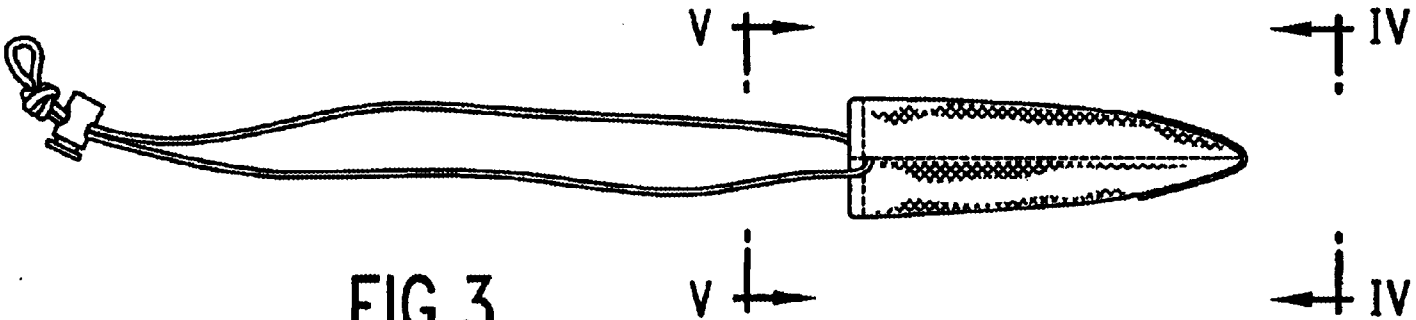
FIG. 3 is a bottom view of the blocking device taken along line III—III in FIG. 2.
Figure 4:
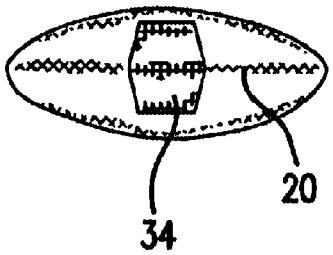
FIG. 4 is an end view of the closed end taken along line IV—IV in FIG. 3.

According to one embodiment of the invention, the center 22 of closed end 20 may be reinforced by attaching a reinforcement member 34 as shown in FIGS. 2, 3 and 4. The reinforcement member 34, which may be made of nylon, leather, burlap, canvas, rubber or other suitably durable material, can be sewn or glued or otherwise attached to the center 22. The reinforcement member 34 may alternately have other complimentary shapes, such as oblong, oval, square, rectangular and include ridges, dimples, etc., within the scope of the invention.

Figure 5:
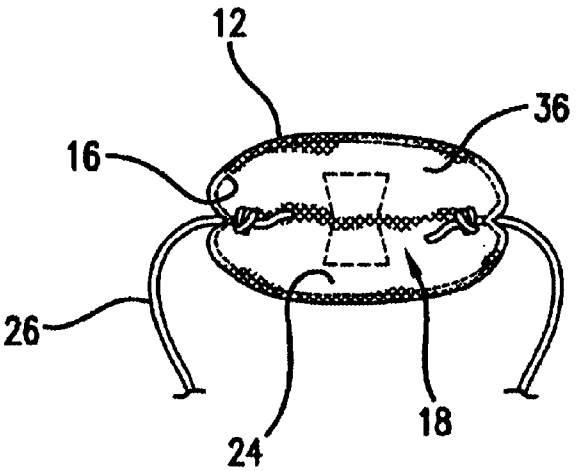
FIG. 5 is an end view of the open end taken along line V—V in FIG. 3.

FIG. 5 best shows the inner surface 16 of cover member 12 as well as cavity 18 and open end 24 into which the barrel end of gun 50 (not shown) is inserted.

According to one embodiment of the invention, the inner surface 16, particularly shown in FIG. 5, may be substantially covered by absorbent material 36. The absorbent material 36 can be affixed to the inner surface 16, for example, by gluing or sewing and may be, for instance, bleached cotton, fiber, cloth, sponge or similar material.

The barrel end of gun 50 is inserted in the cavity 18 through the opening 24 to contact the inner surface 16 proximate the closed end 20. Continued insertion of the gun 50 terminates when the barrel end contacts the closed end 20. After the blocking or safety device 10 is secured to the gun 50 and in the event of an accidental paint ball discharge, the paint moisture is absorbed by the absorbent material 36. Ideally, the blocking device 10, including the casing or cover member 12 and the absorbent material 36, is washable for repeated use.

Figure 6:
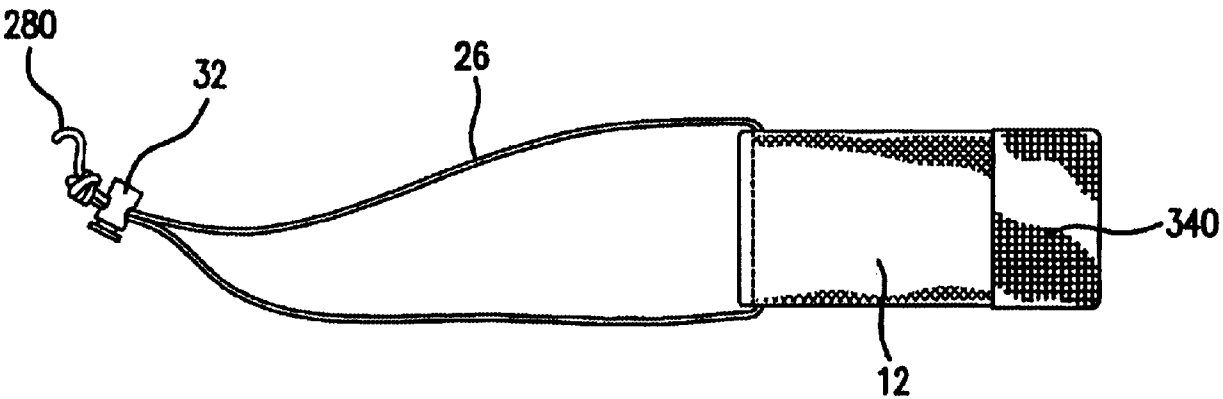
FIG. 6 is a side view of an alternative exemplary embodiment showing an alternative optional reinforcement element.

According to one embodiment of the invention and as shown in FIG. 6, to further assist with barrel protection and longevity of the casing 12, a larger reinforcement member 340 may be provided. More particularly, the reinforcement member 340 can envelope a substantial portion of the casing 12 at its closed end 20. In this illustration, no matter the orientation of the barrel end of gun 50 in the cavity 18, the barrel end of gun 50 will receive additional protection from outside wear and tear, which in turn will increase the durability of the prophylactic device 10.

A manner less preferable but also potentially suitable in some circumstances of connecting prophylactic device 10 to gun 50 is simply using one string (not shown) or lanyard with a hooking or clasping device 280 as shown in FIG. 6. Clasping device 280 can be an S-hook, a thumb-operated clasp hook, and bolt snap or other suitable connector. In this manner a hook or snap can be quickly snapped to some part of gun 50 to secure the safety device 10 in place. Also as shown by FIG. 6, an alternative embodiment of prophylactic device 10 is to mold the casing 12 from plastic, which may be preferable under certain rugged conditions.

Those skilled in the art will recognize that other changes and modifications may be made to the embodiments of the invention described herein without departing from the scope and spirit of the invention. For example, specific shapes, materials and color schemes of the illustrated embodiments may be altered to suit particular firearm applications. It is intended to claim all such changes and modifications as fall within the scope of the appended claims and their equivalents.

That which is claimed is:

1. A safety cover for preventing the unintentional discharge of paintballs from the muzzle of a paintball gun, comprising:

(A) a muzzle cover, wherein said muzzle cover:
- (i) is formed of a material so as to be impenetrable by paintballs from the paintball gun;
- (ii) has a closed end and an opposed open end, said opposed open end defining an opening into a muzzle cavity within said muzzle cover adapted for receipt of the muzzle of a paintball gun;

(B) an attachment cord, wherein said attachment cord:
- (i) is stretchable;
- (ii) has opposing ends, each of said opposing ends being attached to said muzzle cover; and
- (iii) defines a stretchable loop about said opposed open end, whereby said attachment cord may be stretched around one or more protuberance of the paintball gun so as to bias said muzzle cover toward the muzzle of the paintball gun.

2. The safety cover of claim 1, further comprising adjustment means for adjusting the size of said stretchable loop.

3. The safety cover of claim 1, further comprising a cord tension adjuster, wherein said cord tension adjuster is carried by said attachment cord and said cord tension adjuster is selectably movable upon said attachment cord to increase or decrease said size of said stretchable loop.

4. The safety cover of claim 1, further comprising a reinforcement member carried by said closed end such that said closed end is reinforced against the firearm muzzle.

5. The safety cover of claim 1, wherein said muzzle cover defines a length between said closed end and said opposed open end, wherein said muzzle cover further defines a width, said length greater than said width such that said muzzle cover is elongated.

6. The safety cover of claim 1, further comprising means for displaying predetermined communication thereon for viewing when said safety cover is carried by the firearm.

7. A safety cover for preventing the unintentional discharge of paintballs from the muzzle of a paintball gun, comprising:

(A) a muzzle cover, wherein said muzzle cover:
- (i) is pliable;
- (ii) is impermeable to paintballs;
- (iii) has a length and a width, the dimension of said length being greater than the dimension of said width such that the muzzle cover is elongated;
- (iv) has a closed end and an opposed open end, said opposed open end defining a muzzle cavity within said muzzle cover adapted for receipt of the muzzle of a paintball gun;

(B) an attachment cord, wherein said attachment cord:
- (i) is stretchable;
- (ii) has opposing ends, each of said opposing ends being attached to said opposed open end of said muzzle cover;
- (iii) defines a stretchable loop having a size about said opposed open end, whereby said attachment cord may be stretched around one or more protuberance of the paintball gun so as to bias said muzzle cover toward the muzzle of the paintball gun; and (C) a cord tension adjuster, wherein said cord tension adjuster
- (i) is carried by said attachment cord;
- (ii) is selectably movable upon said attachment cord to increase or decrease said size of said stretchable loop.

8. The safety cover of claim 7, further comprising a reinforcement member carried by said closed end such that said closed end is reinforced against the paintball gun muzzle.

9. The safety cover of claim 7, wherein said safety cover defines a length between said closed end and said opposed open end, wherein said safety cover further defines a width, said length greater than said width such that said safety cover is elongated.

10. The safety cover of claim 7, further comprising means for displaying predetermined communication thereon for viewing when said safety cover is carried by the paintball gun.

11. The safety cover of claim 7, wherein the dimension of length is at least about twice the dimension of said width.

12. A method of preventing the unintentional discharge of paintballs from the muzzle of a paintball gun, comprising:

(A) providing a muzzle cover with a closed end to prevent discharge of paintballs from the muzzle of the paintball gun and with an elongated body to cover ports along the barrel of the paintball gun;

(B) providing a stretchable attachment cord, wherein said stretchable attachment cord has opposing ends, each of said opposing ends being attached to said muzzle cover, said stretchable attachment cord defining a stretchable loop;

(C) positioning said muzzle cover over the paintball gun muzzle;

(D) biasing said muzzle cover toward the muzzle by stretching said stretchable loop of said attachment cord around a protuberance of the paintball gun.

* * * * *